US005206467A

United States Patent [19]

Nagai et al.

[11] Patent Number: 5,206,467

[45] Date of Patent: Apr. 27, 1993

[54] MUFFLER WITH A CATALYST

[75] Inventors: Noboru Nagai, Hachioji; Akira Sageshima, Kunitachi; Tadashi Ozaki, Yokosuka; Isao Masuda, Tachikawa, all of Japan

[73] Assignee: Kioritz Corporation, Tokyo, Japan

[21] Appl. No.: 840,979

[22] Filed: Feb. 26, 1992

[30] Foreign Application Priority Data

Mar. 26, 1991 [JP] Japan ..... 3-018492[U]

[51] Int. Cl.[5] ..... F01N 7/02

[52] U.S. Cl. ..... 181/232; 181/243; 181/282

[58] Field of Search ..... 181/211, 222, 224, 229, 181/230, 231, 232, 243, 245, 256, 258, 265, 282; 60/288, 299

[56] References Cited

U.S. PATENT DOCUMENTS

| | | | |
|---|---|---|---|
| 4,418,790 | 12/1983 | Agnew | 181/282 X |
| 4,541,240 | 9/1985 | Munro | 181/243 X |
| 4,866,932 | 9/1989 | Morita et al. | 60/299 |
| 4,867,270 | 9/1989 | Wissmann et al. | 181/231 |
| 4,890,690 | 1/1990 | Fischer et al. | 181/258 X |

*Primary Examiner*—Michael L. Gellner
*Assistant Examiner*—Khanh Dang
*Attorney, Agent, or Firm*—Browdy and Neimark

[57] ABSTRACT

A muffler with a catalyst A muffler closure is detachably attached to the muffler body of the muffler. A thermal insulation acoustic material layer and a catalyst layer are mounted to an inner surface of muffler closure through a porous holding plate along exhaust gas passage.

4 Claims, 1 Drawing Sheet

MUFFLER WITH A CATALYST

BACKGROUND OF THE INVENTION

The present invention relates to a muffler provided with a catalyst.

Various kinds of mufflers with catalysts have been proposed to meet the regulations of engine exhaust gas. Particularly, the conventional small internal combustion engine muffler is however disadvantageous in that: the small muffler provides a small contact area of the catalyst with the exhaust gas, resulting in relatively poor cleaning effect of the exhaust gas; the catalyst is low in efficiency when the temperature of the exhaust gas is relatively low in idling of the engine, for example; and cleaning and replacement of the catalyst are laborious.

SUMMARY OF THE INVENTION

Accordingly, it is an object of the present invention to provide a muffler with a catalyst which is capable of overcoming the previously described drawbacks.

It is another object of the present invention to provide a muffler which is provided with a catalyst in a simple structure.

In view of these and other objects, the present invention provides a muffler with a catalyst, comprising: a muffler body having an open end; a muffler closure, detachably attached to the muffler body to close the open end, the muffler closure having an inner surface; a thermal insulation acoustic layer, mounted over the inner surface of the muffler closure, for thermally insulating the inside from the outside of the muffler closure, the thermal insulation acoustic layer having an inner surface; a catalytic layer, superposed on the inner surface of the thermal insulation acoustic layer, for achieving a catalytic reaction with exhaust gas to clean the exhaust gas, the catalytic layer having an inner surface; and a porous holding means for holding both the thermal insulation acoustic layer and the catalytic layer against the muffler closure, the porous holding means having an inner surface contacting the exhaust gas.

According to the present invention, the following advantages are achieved the catalytic layer is positively attached with ease; the catalytic reaction is effectively performed since the contact area of the catalytic layer with exhaust gas is fairly large; the catalytic layer is excellent in durability since the catalytic layer is arranged along the direction of flow of exhaust gas; loud noises and heat emitted from the muffler are effectively reduced; the catalytic reaction is effectively maintained even when exhaust gas is relatively low in temperature since the thermal insulation acoustic layer is provided outside the catalytic layer; and cleaning and replacement of the catalyst layer are facilitated by removing the muffler closure from the muffler body.

BRIEF DESCRIPTION OF THE DRAWING

In the single drawing.

DETAILED DESCRIPTION OF THE PREFERRED EMBODIMENT

Figure 1:
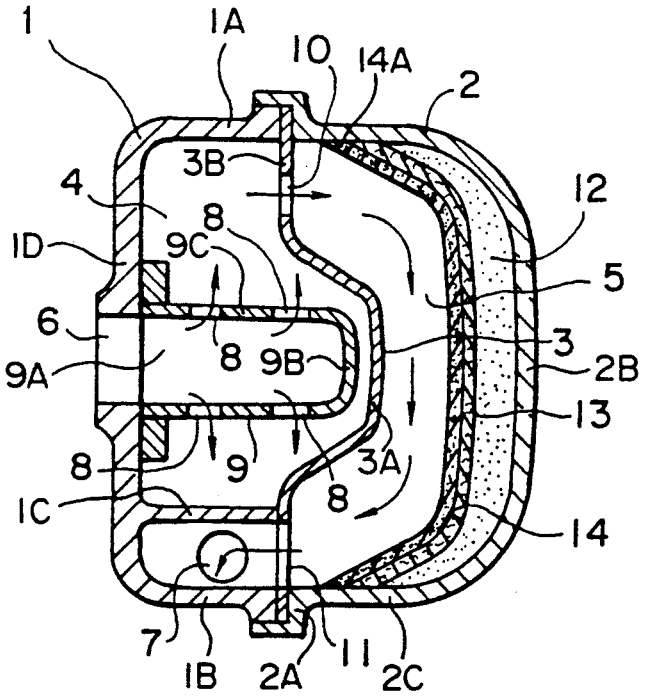
FIG. 1 is a vertical sectional view of a muffler provided with a catalyst according to the present invention.

Referring to the drawing a muffler with a catalyst according to the present invention will be described. The muffler includes a hollow cylindrical muffler body 1 having one open end 1A, and a cup-shaped muffler closure 2. The muffler closure 2 is detachably attached at the open end 2A thereof to the muffler body 1 through machine screws or the like members (not shown) to close the open end 1A of the muffler body 1. The muffler body 1 and the muffler closure 2 hold a substantially dish-shaped partition plate 3 between the two open ends 1A and 2A thereof so that the inside of the muffler is partitioned into first exhaust gas passage 4 and second exhaust gas passage 5. The second exhaust gas passage 5 is defined within the muffler closure 2 whereas the first exhaust gas passage 4 is substantially formed inside the muffler body 1. The muffler body 1 has an inlet 6 and an outlet 7 formed through it. The inlet 6 is formed through a central portion of the closed end 1D of the muffler body 1 for introducing exhaust gas from an internal combustion engine, not shown, such as a two cycle gasoline engine. The outlet 7 is formed through the circumferential wall 1B of the muffler body 1, and is isolated from the first exhaust gas passage 4 through the partition plate 3 and a partition wall 1C. The muffler body 1 is provided with a hollow cylindrical body 9 with one open end 9A. The hollow cylindrical body 9 is mounted to the closed end 1D of the muffler body 1 to surround the inlet 6 and to project into the first exhaust gas passage 4. The closed end 9B of the hollow cylindrical body 9 is received within a centrally recessed portion 3A of the partition plate 3. The hollow cylindrical body 9 has many through holes 8, . . . formed through the circumferential wall 9C thereof so that exhaust gas from the inlet 6 is introduced into the first exhaust gas passage 4 through the holes 8 in a uniformly diverged manner. The partition plate 3 is provided at a flange portion 3B thereof with an upper through hole 10 which communicates the first exhaust gas passage 4 to the second exhaust gas passage 5. The flange portion 3B of the partition plate 3 is further provided with a lower through hole 11 so that the lower through hole 11 is diametrically opposite to the upper through hole 10. The lower through hole 11 communicates the second exhaust gas passage 5 to the outlet 7. With such a construction, exhaust gas which is introduced into the hollow cylindrical body 9 through the inlet 6 flows into the first exhaust gas passage 4 through holes 8, . . . of the hollow cylindrical body 9. Then, exhaust gas flows into the second exhaust gas passage 5 through the upper through hole 10. After exhaust gas flows through the second exhaust gas passage 5, it passes through the lower through hole 11, and is then discharged outside through the outlet 7.

The muffler closure 2 is provided on an inner surface of a bottom portion 2B thereof with a thermal insulation acoustic layer 12 to be recessed in the same direction as the recessed portion 3A of the partition plate 3. The thermal insulation acoustic layer 12 is made of a thermal insulation acoustic material such as a ceramic wool. A catalyst layer 13 made of a catalyst such as a cloth catalyst is arranged over the thermal insulation acoustic layer 12 to sandwich the thermal insulation acoustic layer 12 between it and the bottom portion 2B of the muffler closure 2. A porous member 14, such as perforated metallic plate and a wire net, is superposed over the catalyst layer 13. The porous member 14 is welded at the peripheral edge 14A thereof to the inner surface of a circumferential wall 2C of the muffler closure 2 by spot welding, for example, so that the thermal insulation acoustic layer 12 and the catalyst layer 13 and held against the inner surface of the bottom portion 2B of the muffler closure 2.

With such a construction, exhaust gas which flows along the second exhaust gas passage 5 flows along the wide inner surface of the porous member 14. In this event, exhaust gas enters through the porous member 14 into the catalyst layer 13, where exhaust gas makes chemical reaction with the catalyst of the catalyst layer 13, so that exhaust gas is completely combustioned for cleaning, and is then discharged outside through the outlet 7. The thermal insulation acoustic layer 12 which covers the outer surface of the catalyst layer 13 provides the following advantageous effects: the thermal insulation acoustic layer 12 prevents the catalyst layer 13 from giving any thermal adverse influence to synthetic resin structures such as a cylinder cover; loud noises from the muffler are effectively reduced; the catalytic reaction is effectively maintained even when exhaust gas is relatively low in temperature, such as in idling of the engine; and cleaning and replacement of the thermal insulation acoustic layer 12 and the catalyst layer 13 are facilitated by removing the muffler closure 2 from the muffler body 1.

The cylindrical body 9 has such a length as to project into the muffler closure 2, whereas the partition plate 3 is recessed toward the muffler closure 2 so that the partition plate 3 does not make a contact with the cylindrical body 9. This makes the second exhaust gas passage 5 fairly long, and therefore reaction area of the catalyst layer 13 is increased and noise suppressing effect is enhanced.

The inner surface of the muffler closure 2 may be provided with irregularity, and the thermal insulation acoustic layer 12, the catalyst layer 13, and the porous member 14 may be mounted over the muffler closure 2 to follow the irregular inner surface of the muffler closure 2. This enables the muffler to be further enhanced in both catalytic effect and positive holding of the members 12, 13 and 14.

What is claimed is:

1. A muffler with a catalyst, comprising:

a muffler body having an open end;

a muffler closure, detachably attached to the muffler body to close the open end, the muffler closure having an inner surface;

a thermal insulation acoustic layer, mounted over the inner surface of the muffler closure, for thermally insulating the inside from the outside of the muffler closure, the thermal insulation acoustic layer having an inner surface;

a catalytic layer, superposed on the inner surface of the thermal insulation acoustic layer, for achieving a catalytic reaction with exhaust gas to clean the exhaust gas, the catalytic layer having an inner surface; and a porous holding means for holding both the thermal insulation acoustic layer and the catalytic layer against the muffler closure, the porous holding means having an inner surface contacting the exhaust gas.

2. A muffler with a catalyst as recited in claim 1, further comprising:

a partition member for partitioning the inside of the muffler into first exhaust gas passage and second exhaust gas passage, the first exhaust gas passage being defined by the muffler body and the partition member whereas the second exhaust gas passage is defined by the muffler closure and the partition member;

passing means for passing exhaust gas from the first exhaust gas passage to the second exhaust gas passage; and discharging means for discharging exhaust gas from the second exhaust gas passage to outside of the muffler.

3. A muffler with a catalyst as recited in claim 2, wherein:

the inner surface of the muffler closure has a shape outwardly recessed;

the thermal insulation acoustic layer, the catalytic layer and the porous holding means are outwardly recessed to follow the outwardly recessed shape of the muffler closure; and the partition member has a portion outwardly recessed, the portion facing to the muffler closure, the portion and the inner surface of the porous holding means defining a curved second exhaust gas passage.

4. A muffler with a catalyst as recited in claim 3, wherein:

the muffler body comprises exhaust gas diverging means for uniformly diverging exhaust gas, entered into the muffler body, into the first exhaust gas passage, the diverging means having a closed inner end portion located adjacent to the recessed portion of the partition member for defining a curved exhaust passage between the closed inner end portion and the recessed portion of the partition member.

* * * * *